United States Patent [19]

Anderson

[11] 3,987,501

[45] Oct. 26, 1976

[54] TOILET FLUSH ASSEMBLY

[75] Inventor: Robert V. Anderson, Fort Worth, Tex.

[73] Assignee: Producers Specialty & Mfg. Co., Inc., Fort Worth, Tex.

[22] Filed: June 27, 1975

[21] Appl. No.: 590,796

Related U.S. Application Data

[63] Continuation-in-part of Ser. No. 479,896, June 17, 1974, abandoned.

[52] U.S. Cl. ..... 4/67 R; 4/30; 4/31

[51] Int. Cl.[2] ..... E03D 1/34

[58] Field of Search ..... 4/67, 67 A, 57, 20, 4/15, 26, 30, 31, 38, 41, 43, 56, DIG. 1

[56] References Cited

UNITED STATES PATENTS

| | | | |
|---|---|---|---|
| 3,662,408 | 5/1972 | Knudtson | 4/67 R |
| 3,900,904 | 8/1975 | Braswell | 4/67 R |

*Primary Examiner*—Robert I. Smith
*Attorney, Agent, or Firm*—Schmidt, Johnson, Hovey & Williams

[57] ABSTRACT

A control for the outlet of a liquid supply tank such as, for example, the water tank of a toilet, utilizes the retention or escape of air trapped above a valve float of the control to seat and unseat the valve against the outlet respectively. One embodiment has a standpipe extending vertically and centrally through the upper air trapping housing of the control for supporting such housing while the float reciprocates slidably along the standpipe between its lowered and buoyed positions. A second embodiment is adapted for use in existing installations wherein the standpipe is offset laterally from the outlet, the standpipe thus extending outside of and supporting the housing while the float is guided in its vertical reciprocation by internal ribs on the housing. A number of alternative arrangements are disclosed for manual actuation of the control, for automatic actuation thereof when the liquid within the tank reaches a predetermined level, and for automatic actuation only if manual actuation has not occurred prior to the water reaching such predetermined level. An additional embodiment has the seat for the valve rigidly connected to the housing in a unitary manner so that, regardless of whether the housing is accidentally tilted relative to the water tank, the valve and its seat are always maintained in proper sealing alignment.

14 Claims, 12 Drawing Figures

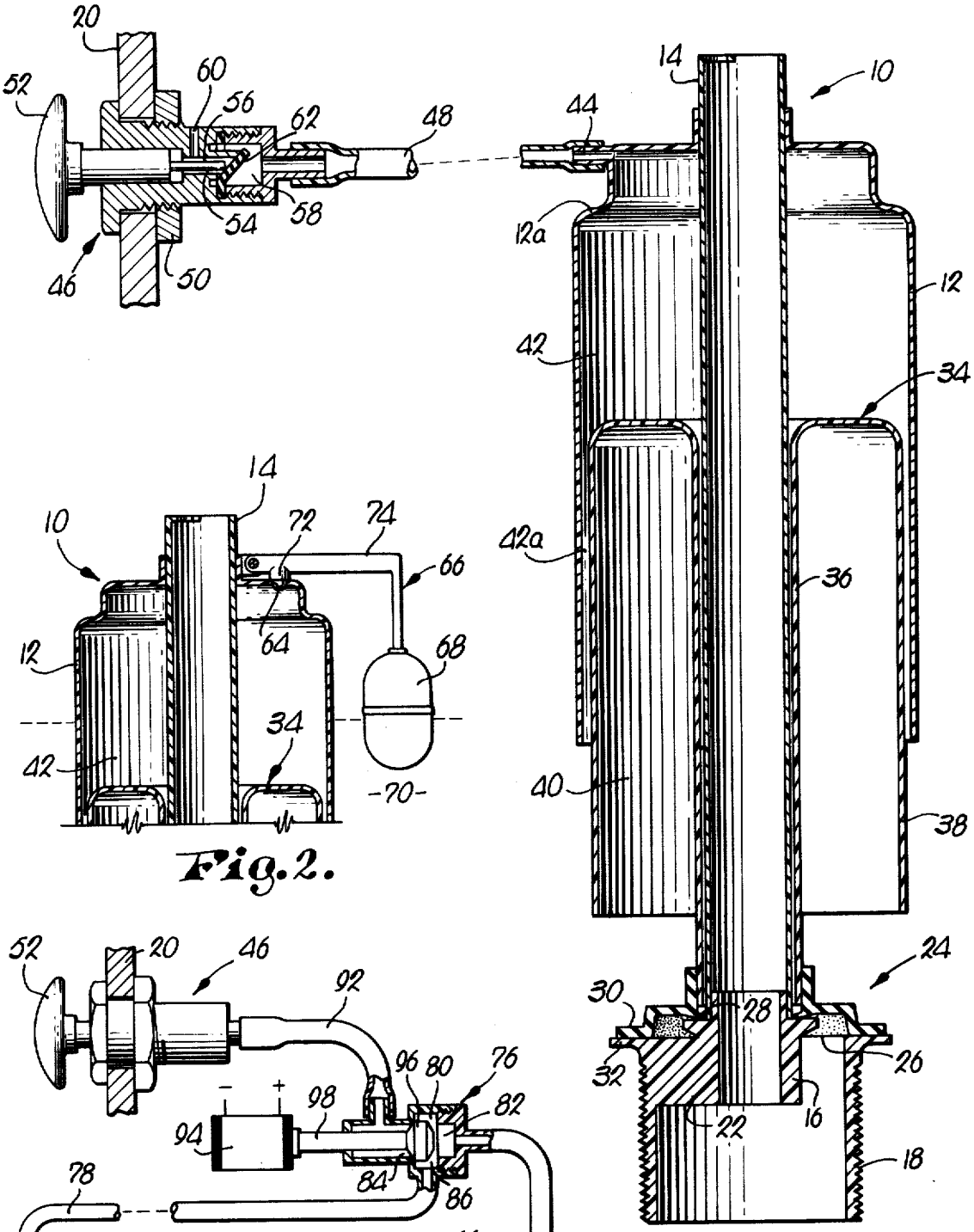
Fig. 1.
Fig. 2.
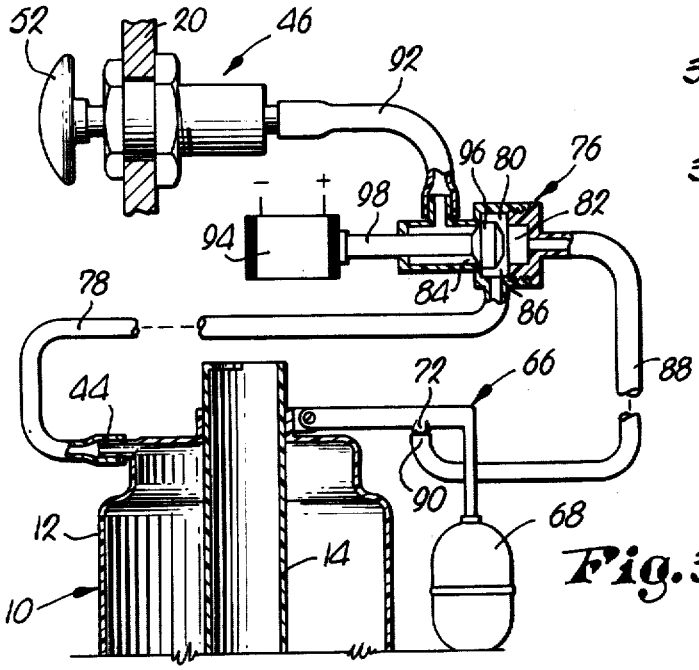
Fig. 3.

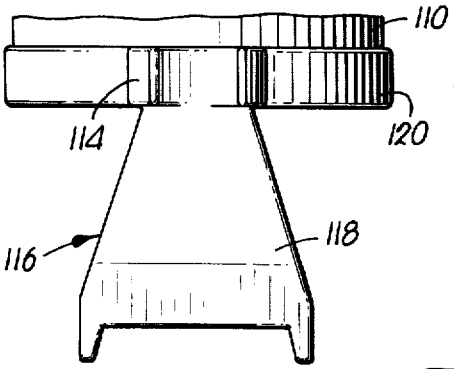
Fig.7.
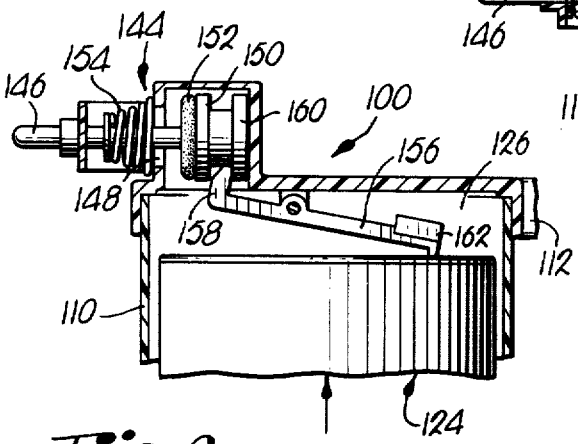
Fig.6.
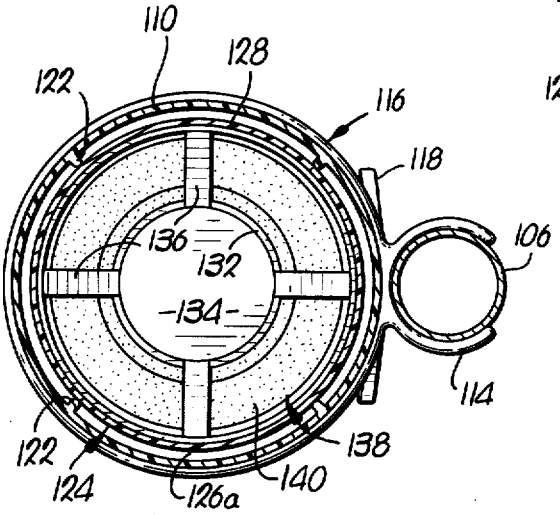
Fig.5.
Fig.4.
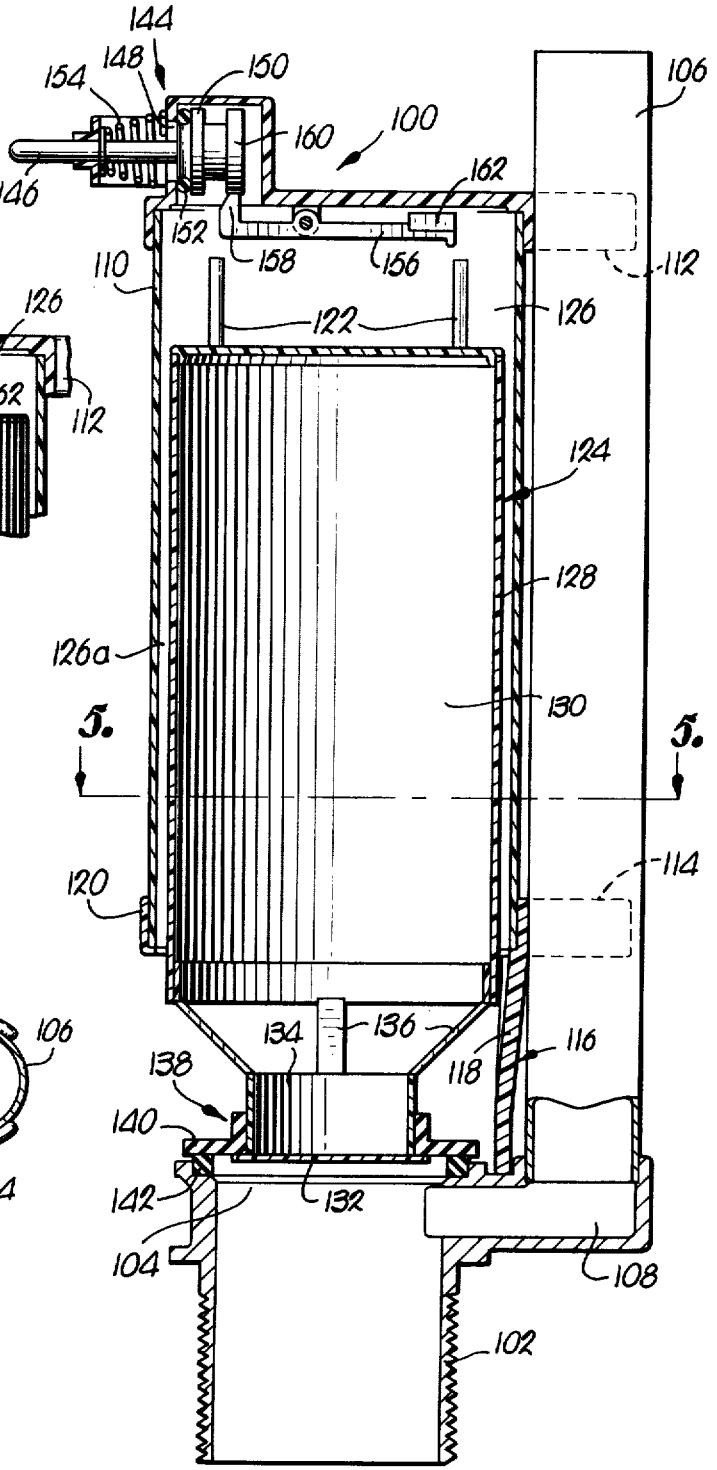

Fig. 11.
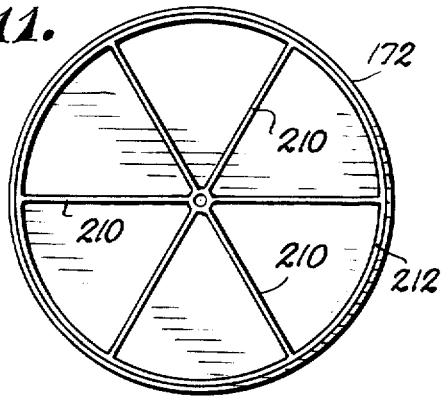
Fig. 12.
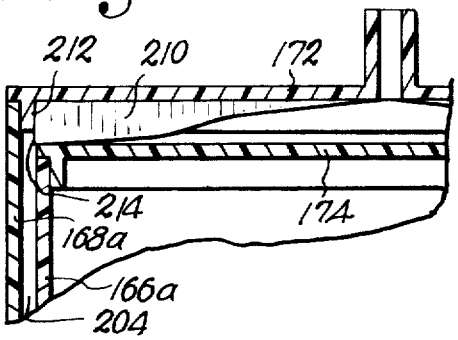
Fig. 8.
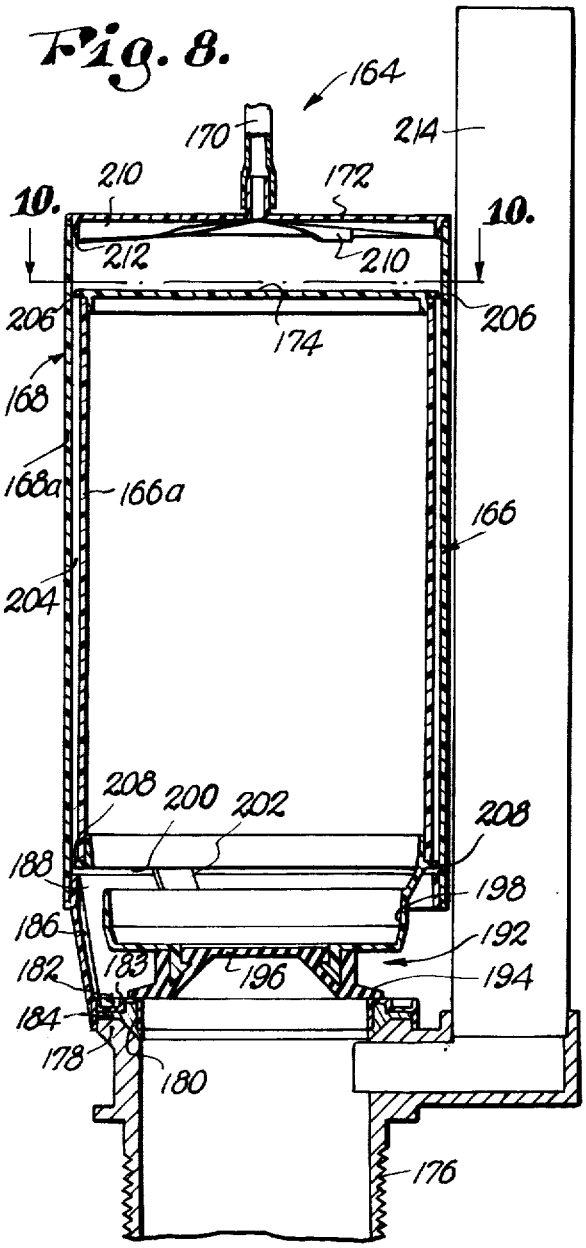
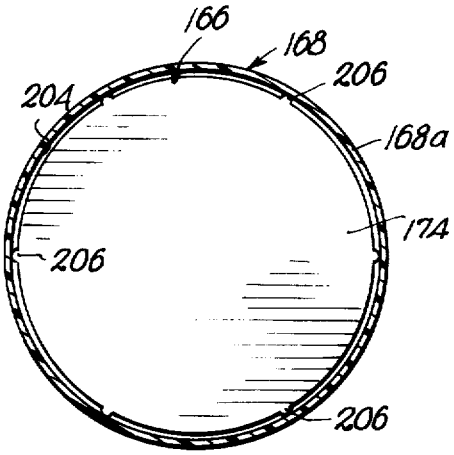
Fig. 10.
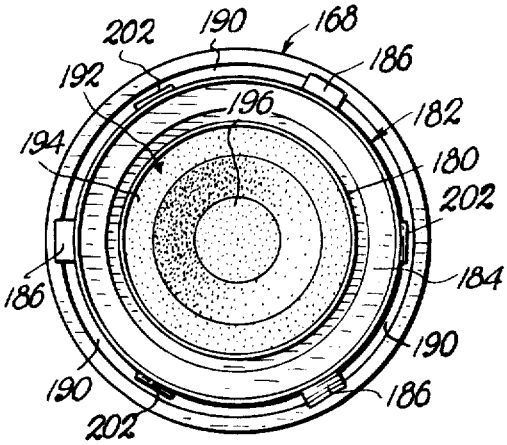
Fig. 9.

TOILET FLUSH ASSEMBLY

CROSS REFERENCES

This is a continuation-in-part of my prior copending application Ser. No. 479,896 by the same title, filed June 17, 1974 and now abandoned.

This invention relates to means for controlling the outlet of a liquid supply tank, having particular utility for use in the water tank of a toilet for releasing the water from the tank when the toilet is to be flushed.

One important object of the present invention is to provide a new control which eliminates the complex and costly linkages, cranks, arms and rods normally associated with conventional mechanisms for controlling an outlet, such as that of the water tank of a toilet.

Another important object of this invention is to provide a control which, while being of rather simple design to eliminate the numerous problems inherent in previous more complex mechanisms, is nonetheless highly reliable and efficient in operation, being capable of simple actuation, quiet operation, and reliable sealing in order to prevent the inadvertent and annoying escape of water from the tank.

Pursuant to the foregoing, an additional important object of the instant invention is the provision of a valved float which seals the outlet when air is trapped above the float in order to prevent its upward displacement within the tank and which opens the outlet upon release of the trapped air to enable the float to be buoyed up out of its lowered position.

Yet another important object of this invention is the provision of an essentially pneumatically operating control as set forth in the foregoing object which can be installed on existing toilets with a minimum of adaptation or can be provided as part of the initial installation equipment of the toilet.

Other important objects of the invention include providing means for quick, reliable actuation of the control, providing means for automatically actuating the control when water within the tank reaches a predetermined level, and providing means for selectively setting the control for auotmatic or manual actuation individually, or either of the foregoing arrangements concurrently.

It is also an important object of the invention to assure complete sealing of water tank outlet by the valved float even if the housing in which the float operates is cocked to one side.

A still further important object of this invention is to maintain the float in concentric relationship with its housing and valve seat during operation in order to assure proper sealing and yet to overcome any tendency for the float to hang up in the housing following a flush cycle as a result of water surface tension.

In the drawings:

FIG. 1 is a vertical cross-sectional view through one embodiment of the control of the present invention, the float of the control being shown in its lowered or sealing position and the control being adapted for manual actuation;

FIG. 2 is a fragmentary, vertical cross-sectional view through the control on a reduced scale illustrating means for automatically actuating the control when water within the tank reaches a predetermined level;

FIG. 3 is a fragmentary, partly elevational and partly vertical cross-sectional view of the control illustrating an arrangement for manually actuating the control, for automatically actuating the control, or for automatic actuation only if manual actuation has not occurred prior to the time water within the tank reaches a predetermined level;

FIG. 4 is a vertical cross-sectional view of a second embodiment of the control adapted for use on existing installations, the float thereof being shown in its lowered position sealing the outlet of the tank;

FIG. 5 is a horizontal, cross-sectional view of the second embodiment taken along line 5—5 of FIG. 4;

FIG. 6 is a fragmentary, vertical cross-sectional view of the second embodiment illustrating the manner in which the latch for the actuating plunger of the control is released as the float approaches it buoyed position;

FIG. 7 is a fragmentary, elevational view of the mounting bracket for the control located at the lower right-hand corner of FIG. 4;

FIG. 8 is a fragmentary, vertical cross-sectional view of a third embodiment of the invention;

FIG. 9 is a bottom plan view of the float, its housing and the valve seat secured to the housing;

FIG. 10 is a horizontal, cross-sectional view of the housing and float taken along line 10—10 of FIG. 8;

FIG. 11 is a plan view of the inside surface of the top of the housing illustrating the spacing ribs on the top; and FIG. 12 is an enlarged, fragmentary detail view of one corner of the housing and float illustrating the side annulus between the housing and the float and the space which is maintained between the top of the housing and the top of the float when the latter is fully buoyed up.

The control 10 includes a cylindrical, open bottom and closed top housing 12 secured at its uppermost end to a standpipe member 14 that projects downwardly and centrally through housing 12 for securance to a hollow, tubular component 16 mounted within a tubular, externally threaded outlet element 18. It is to be understood that the element 18 is threaded into the floor (not shown) of a liquid supply tank such as, for example, the water tank of a toilet having an upright wall 20 shown fragmentarily in FIG. 1. Depending upon whether or not control 10 is uitilized in conjunction with a toilet, the standpipe member 14 and component 16 may or may not be tubular, such being necessary only to supply an amount of water from an external source into the trap of the toilet through element 18 after each flush in order to provide a seal against gas fumes emanating from sewer pipes coupled with the toilet.

The component 16 is supported in radially spaced relationship to the walls of element 18 by a number of radially extending vanes 22 (only one being shown) which thereby position component 16 concentrically within element 18 and yet allow the latter to have virtually unrestricted passage of water from the tank therethrough. A valve 24 is disposed for opening or closing the outlet 26 defined by the open upper end of element 18, and such valve 24 is provided with a pair of inner and outer, resilient, annular seals 28 and 30 respectively that may be seated against component 16 and the lip 32 of element 18 to close outlet 26.

Opening and closing of outlet 26 by valve 24 is determined by the vertical position of a float 34 having a tubular neck 36 slidably surrounding standpipe 14 and secured at its lower end to valve 24. Float 34 also has a cup-like shroud 38 that encircles neck 36 in radially spaced relationship thereto to define an annular region 40 between neck 36 and shroud 38 for trapping air. By virture of its slidable movement along standpipe 14, the float 34, with valve 24 attached, is rendered reciprocable within a chamber 42 defined within housing 12 between its top and bottom. For purposes which will hereinafter become apparent, the inner seal 28 of valve 24 extends inwardly from neck 36 into engagement with standpipe 14 in order to close off any annular space between standpipe 14 and neck 36 when valve 24 closes outlet 26 as illustrated in FIG. 1.

The chamber 42 within which float 34 reciprocates vertically is adapted to successively trap and release air above float 34 during the operating cycle of control 10. Various arrangements, yet to be described, may be provided for maintaining the air trapped within chamber 42 and for releasing such air, but before describing such arrangements in detail, it would seem appropriate at this juncture to fully set forth the basic manner of operation of control 10. Assuming, then, that the water tank is filled with water to a point, for example, approximately half-way up housing 12 and air is trapped within chamber 42 above float 34, the latter will be held by the trapped air against any upward displacement, even though a second volume of air may be trapped within region 40. Hence, float 34 will remain at this time in its lowered position wherein valve 24 fully closes outlet 26. Manifestly, the pressure against valve 24, and particularly against seals 28 and 30 helps maintain valve 24 well seated.

Upon releasing the trapped air within chamber 42 by suitable means, water which has previously been maintained by the trapped air out of the annulus 42*a* between float 34 and housing 12 is allowed to enter annulus 42*a* and chamber 42 proper, covering float 34 and allowing the latter to be buoyed up by its own volume of air trapped within region 40. The extent of movement of float 34 upwardly into its buoyed position need only be sufficient to lift valve 24 from outlet 26 for discharge of the water from the tank through element 18, thus flushing the toilet. In the arrangement in FIG. 1, the float 24 will be buoyed upwardly until the upper end thereof engages the inturned, annular shoulder 12*a* of housing 12, at which time the lowermost edge of shroud 38 will be retracted a short distance within the open bottom of housing 12.

As the water level within the tank drops below the bottom of housing 12 and lowermost edge of shroud 38, the water within annulus 42*a* escapes, allowing float 34 to settle downwardly until valve 24 is reseated over outlet 26. This, of course, terminates discharge of water from the tank and causes a new supply to be retained as water is fed into the tank by means not illustrated.

As the tank is refilled and the water level begins to climb, air again becomes trapped within chamber 42 so long as the selected escape mechanism for the latter is properly closed at this time. The water level continues to rise until such time as a predetermined level is reached, whereupon filling may be terminated.

It is important to recognize that the valve 24 is so designed that it becomes progressively seated tighter and tighter over outlet 26 as the water level rises during refilling. In this respect, it should be apparent that the outer seal 30 cannot help but be pressed progressively more firmly against lip 32 as water pressure at the bottom of the tank increases. In addition, because air trapped within chamber 42 is subjected to the ever increasing efforts of the rising water to enter annulus 42*a* and push air out of chamber 42 in any direction possible, the air pressure within the area of loose fit between standpipe 14 and neck 36 also progressively increases. Without the special design of valve 24 such action might tend to provide an escape for the air when a sufficient pressure level was reached, thereby enabling water to enter chamber 42 and cause a continuous annoying discharge or flush of the water from the tank. Such is entirely prevented, however, by virtue of the special inner seal 28 that is disposed directly below the area between neck 36 and standpipe 14, thereby causing seal 28 to be pressed ever more firmly into sealing engagement with component 16 as the water level within the tank rises. Thus, the only tendency is to more positively close off any means of escape for the trapped air as the water level rises, rather than increasing the likelihood of escape of the trapped air. Accordingly, any tendency for the control 10 to inadvertently acutate itself, resulting in costly wastage of water is entirely avoided.

Several different means may be provided for actuating the control 10, three of which are illustrated in FIGS. 1, 2 and 3, and a fourth of which is illustrated in connection with the second embodiment of the control detailed in FIGS. 4 and 6. With specific reference to the arrangement illustrated in FIG. 1, the housing 12 is provided with a nipple 44 projecting outwardly therefrom adjacent the top of housing 12, such nipple 44 being coupled with a valve body 46 through a conduit 48. The valve body 46 is attached to the wall 20 of the tank by virtue of a nut 50 threaded onto body 46 on the inside of wall 20, and has a manually actuatable hand knob 52 that is disposed on the outside of wall 20 for convenient manual depression. Knob 52 has a plunger 54 reciprocable within a bore 56 that communicates a valve chamber 58 of body 46 with an exhaust port 60. A resilient flap valve 62 spans the end of bore 56 within valve chamber 58, and the inherent memory of flap valve 62 causes the latter to remain yieldably across bore 56 is closing relationship thereto. Hence, when knob 52 is pushed inwardly, its plunger 54 pushes flap valve 62 off of its seat to communicate chamber 42 of housing 12 with exhaust port 60, thus allowing the escape of trapped air from housing 12. Upon release of pressure from knob 52, flap valve 62 springs back to its normal, closed position, hence terminating the escape of air through exhaust 60 and pushing knob 52 back to its normal, fully extended position.

FIG. 2 illustrates an arrangement for automatic discharge of water within the tank when the level thereof rises to a predetermined height. Accordingly, instead of the manually actuatable knob 52 and valve body 46 of FIG. 1, the housing 12 in FIG. 2 has an orifice 64 in its top that is controlled by a buoyant device 66. Device 66 includes a bulb 68 adapted for flotation within the water 70 of the tank when water 70 reaches the proper level, such flotation causing a plug 72 on a swingable arm 74 of device 66 to be lifted out of orifice 64, thereby allowing air trapped within chamber 42 to escape from the latter. In this manner, the toilet may be automatically flushed at uniform intervals dependent upon the rate of filling of the tank and, in addition, overfilling and overflowing of the tank is prevented.

FIG. 3 shows another arrangement wherein the control 10 may be automatically actuated, manually actuated, or automatically actuated only if manual actuation has not occurred prior to the level in the tank reaching a predetermined height. To accomplish this versatility the nipple 44 of housing 12 is coupled with a valve body 76 through a conduit 78. The body 76 is hollow, presenting a valve chamber 80 that is provided with a pair of opposed ports 82 and 84, as well as an intermediate port 86. Port 86 communicates chamber 80 with conduit 78, while port 82 communicates chamber 80 with another conduit 88 having the float device 66 of FIG. 2 disposed to control the outlet end 90 of conduit 88 by virtue of the plug 72 being seatable within end 90 to close the latter until the water level reaches a sufficient height to float the bulb 68. The port 84 communicates chamber 80 with an additional conduit 92 coupled with the valve body of FIG. 1.

A suitable three-position actuating unit 94, which may be electrically powered, has a poppet valve 96 within valve chamber 80 at the outer end of the plunger 98 of unit 94. In the position shown, poppet 96 closes conduit 92 to valve chamber 80, and hence, the escape or retention of air from housing 12 is controlled solely by the device 66 inasmuch as escaping air can only traverse the path defined by conduit 78, port 86, valve chamber 80, port 82, and conduit 88. Thus, in this situation, the control 10 is adapted for automatic actuation each time the water level within the tank rises to a predetermined height.

On the other hand, when the poppet 96 is shifted to the opposite extreme closing port 82, the control 10 is adapted for manual actuation only. At this time, the escape path for air from housing 12 can only be along conduit 78, port 86, valve chamber 80, port 84, and conduit 92, thus meaning that knob 52 must be intentionally depressed if control 10 is to be actuated.

A third situation can be presented wherein the poppet 96 is moved to an intermediate position within valve chamber 80 sealing none of the ports 82, 84 and 86. With poppet 96 so positioned, air leaving housing 12 through conduit 78 can escape through either of two equally accessible routes, i.e., conduit 92 or conduit 88. When knob 52 is fully extending and the water level within the tank is not yet high enough to float bulb 68, air cannot escape from housing 12. Should knob 52 be depressed prior to the water reaching such predetermined level sufficient to float bulb 68, the escape of air from body 76 will be through conduit 92. On the other hand, if no manual actuation of knob 52 occurs before bulb 68 is floated, then control 10 will be automatically actuated as bulb 68 raises its plug 72 off end 90 to allow escaping air to flow through conduit 88. Hence, with this arrangement, the control 10 is adapted for either manual or automatic actuation whichever happens to occur first.

The control 100 illustrated in FIGS. 4–7 is especially suited for use in an existing toilet installation wherein a tubular outlet element 102, defining an outlet 104 at its upper end, is disposed in the floor of a water tank, and a standpipe member 106 is disposed to one side of element 102 and outlet 104. The tubular standpipe 106 communicates with element 102 through a transverse passage 108 so as to supply fluid for the trap of the toilet in the same manner as the arrangement in FIG. 1, but it is to be recognized that standpipe 106 is not coaxial with element 102 as in the FIG. 1 arrangement.

The open bottom, closed top housing 110 of control 100 is secured to standpipe 106 in superimposed relationship to outlet 104 by an upper, generally C-shaped collar 112 and by a lower, generally C-shaped collar 114 forming a part of a larger bracket 116. The latter has a generally upright section 118 that stands on structure defining the transverse passage 108 and also has an integral ring 120 about the bottom of housing 110.

The housing 110 is provided with a series of circumferentially spaced, longitudinally extending ribs 122 that guide a float 124 for vertical reciprocation within the chamber 126 defined within housing 110. Float 124 has an open bottom, closed top, upper portion 128 that defines an open bottom, air-receiving compartment 130 and also has an open top, closed bottom, lower portion 132 defining an open top, water-receiving, ballast compartment 134. Portion 132 is suspended below and in coaxial relationship with upper portion 128 by a series of downwardly and inwardly extending spaced struts 136, thus providing ingress to compartments 130 and 134 for air and water respectively. A valve 138 having a flexible seal 140 encircles lower portion 132 and is disposed to place its seal 140 in seating engagement with a sealer ring 142 of outlet element 102 when float 124 is fully lowered as shown in FIG. 4, thus closing outlet 104.

Control 100 operates in the same basic manner as control 10, with the vertical position of float 124 within housing 110 determining whether outlet 104 is closed or opened by valve 138. When air is trapped within chamber 126 above float 124, the latter is held downwardly in its lowered position, seating seal 140 against ring 142. Thus, water within the tank is not allowed to escape through outlet 104 at such time.

However, when the trapped air above float 124 is released, water travels upwardly into the annulus **126*a* between float 124 and housing 110, thereby allowing air which has previously become trapped within compartment 130 to buoy float 124 upwardly, thereby unseating valve 138 and opening outlet 104 to flush the toilet. If mechanism 144 is closed as shown in FIG. 4, float 124 is retained in its buoyed position within housing 110 until the water level of the tank drops below the bottom of housing 110, whereupon float 124 drops by gravity into its lowered position. Should the water level within the tank become lower than portion 132 of float 124 while the latter tends to remain within housing 110 (such as by water surface tension, vacuum effect, or friction between the components), water which has collected within ballast compartment 134 will encourage the float 124 to drop freely into its lowered position. Once valve 138 fully closes outlet 104, the refilling cycle can begin, whereupon air once again becomes trapped within chamber 126 above float 124 to resist unseating of valve 138 until float 124** is purposely allowed to buoy up at the next flushing cycle.

It will be recognized that a number of suitable arrangements can be provided for controlling the release of trapped air within chamber 126 for actuating control 100. Such arrangements may take the form of those illustrated in FIGS. 1–3, for example, or, the mechanism 144 of FIGS. 4 and 6 may be utilized. Mechanism 144 includes a plunger 146 extending outwardly beyond the wall (not shown) of the tank for external manual actuation. An orifice 148 in a raised section of the top of housing 110 communicates chamber 126 with the interior of the tank, such orifice 148 also receiving plunger 146 for reciprocation of the latter therewith. A first shoulder 150 on the inner end of plunger 146 mounts an O-ring 152 in disposition to seal the orifice 148 when plunger 146 is fully extended as shown in FIG. 4, while such O-ring 152 opens orifice 148 when plunger 146 is fully depressed as shown in FIG. 6. A coil spring 154 yieldably biases plunger 146 toward its extended position, while a special weighted latch 156 depending from the top of housing 110 within the latter has a hook 158 that catches a second shoulder 160 of plunger 146 when the latter is fully depressed in order to releasably retain plunger 146 in such position. As illustrated in FIG. 6, the weighted end 162 of latch 156 is disposed for engagement by float 124 as the latter approaches its fully buoyed position whereby to swing latch 156 in a direction to release hook 158 from shoulder 160, hence allowing plunger 146 to return to its normal extended position.

The control 164 illustrated in FIGS. 8–12 is similar in many respects to the controls 10 and 100 of FIGS. 1–7, but also has certain important improvements thereover. As in the first two embodiments, control 164 includes a float 166 that operates within an open bottom housing 168, the latter having a tube 170 leading from the top 172 of housing 168 for communicating with a suitable actuating valve (not shown) to trap and release air below the top 172 of housing 168 and above the top 174 of float 166.

The outlet element 176 threaded into the floor (not shown) of the liquid supply tank has an upwardly projecting annular portion 178 at its uppermost end. Portion 178 is in turn matingly received within a downwardly facing, annular cavity 180 formed in an annular seat 182. A suitable sealing substance 184 is provided within cavity 180 to prevent leakage between the seat 182 and portion 178 and to adhere seat 182 to the outlet element 176. One product that has been found suitable for substance 184 is manufactured and sold under the trademark PRESSTITE by the Inmount Corporation of St. Louis, Missouri.

While in the first two embodiments the necessary sealing engagement between the float and the outlet was made between a valve on the float and the outlet itself, control 164 departs from this basic concept and makes the seat 182 unitary with housing 168 so that regarless of the fact that housing 168 might be accidentally cocked relative to outlet 176 when control 164 is installed, the relationship between seat 182 and housing 168 will remain constant. To this end, then, three flat hangers 186 depend from the open bottom 188 and suspend the seat 182 in spaced relationship to such open bottom 188 below the latter. Inasmuch as the upper ends of hangers 186 are rigid to the housing 168 and the lower ends of hangers 186 are rigid to the seat 182, the latter is rendered immobile relative to housing 168. As illustrated in FIG. 9, the hangers 186 are circumferentially spaced around the open bottom 188 and thereby define open areas 190 therebetween which allow the ingress and egress of liquid relative to bottom 188.

As in the first two embodiments, a valve 192 having a flat annular seal 194 is suspended below and attached to float 166 for reciprocation with the latter during its operation within housing 168. The flat seal 194, of course, is disposed for sealing engagement with the top surface 183 of seat 182 so that liquid passing through areas 190 from within the tank cannot enter outlet 176 so long as seal 194 engages surface 183. Valve 192 also has a top web 196 integral with seal 194 that closes off the middle of outlet 176 when float 166 is disposed as illustrated in FIG. 8, and web 196 doubles as part of the floor of an open top, liquid-receiving ballast cup 198. The latter is suspended from the open bottom 200 of float 166 by three circumferentially spaced apart, flat hangers 202 similar to the hangers 186.

As illustrated, float 166 is smaller in cross-sectional diameter than its housing 168 in order to provide clearance for float 166 during its reciprocation. A void side annulus 204 is thereby defined between the sides **166*a* of float 166 and the sides 168*a* of housing 168. While annulus 204 must be of sufficient size to permit the unrestricted operation of float 66, nonetheless it tends to provide an area within which the float 166 can become canted or cocked relative to housing 168 such as to adversely affect the quality of seal between seat 182 and the seal 194**.

This opportunity for cocking, however, is completely overcome through the provision of spacer means between the walls **166*a* and 168*a* in the nature of small projections 206 and 208 on wall 168*a* projecting outwardly from the latter across annulus 204. Projections 206 are arranged in a circular series adjacent top 174 and are circumferentially spaced apart around the latter as illustrated best in FIG. 10. Similarly, the projections 208 are arranged in a circular series and are spaced apart circumferentially in the same manner as projections 206. Wall 166*a* between projections 206 and 208 is devoid of any outwardly extending structures of any kind to avoid interference with the centering action provided by the projections 206 and 208. Of course, a very slight clearance is provided between projections 206, 208 and the housing wall 168*a*, but such clearance need only be quite small compared to the size of annulus 204, it being necessary only to provide sufficient clearance for projections 206, 208 to move unhindered along wall 168*a***.

Spacing means is also provided between the tops 172 and 174 of housing 168 and float 166 respectively in order to prevent tops 172, 174 from coming into direct engagement with one another after initiation of a flushing cycle. Such top spacer means may take the form of a number of radially extending, flat fins 210 which are integral with top 172 and extend edgewise downwardly from the latter. Any number of such fins 210 may be provided, it being necessary only to provide some structure in that area which will limit the upward stroke of float 166 without providing a broad surface area to engage top 174.

While the number of fins 210 is subject to variation without significant effect on operability, the width of each fin 210, top-to-bottom, is of significantly more importance. In this respect, it is to be noted that the top 172 has a depending, annular extension 212 as shown in FIG. 12 situated between the wall **168*a* and the outermost ends of fins 210 in order to properly locate top 172 relative to the wall 168*a* during assembly of housing 168. It has been found that, under certain conditions, the float 166 can be unintentionally held in its uppermost position in housing 168 by the surface tension of liquid between tops 172 and 174 unless the space designated 214 between extension 212 and top 174 of float 166 is at least as wide as the annulus 204 when float 166 is fully raised. Thus, as aforementioned, the fins 210 are designed to assure that space 214 can never be less than the thickness of annulus 204 when the latter is of uniform thickness around the entire periphery of float 166. This relationship assures that the area above top 174 of the float 166 can become fully drained during a flushing cycle, to the end that there is no tendency for the float 166 to be accidentally retained in its raised position. The latter condition would, of course, maintain valve 192 off its seat 182** such that the liquid tank could not fill.

In all other respects, the operation of the control 164 is identical to that explained with regard to the first two embodiments. It should be noted, however, that while the three embodiments have basic principles of operation in common, the structural improvements found only in control 164 in many instances make it the preferred embodiment of the invention because of its even greater reliability with the same or even less cost.

It is important to note that making the seat 182 in effect a part of the housing 168 promotes efficient and trouble-free operation. Inasmuch as seat 182 is constantly maintained in proper relationship with housing 168, seat 182 is always properly disposed for sealing engagement with valve 192 of float 166. Thus, it matters not that housing 168 might be somewhat haphazardly installed by a careless workman who failed to establish housing 168 with its longitudinal axis truly vertical. So long as a fluid seal is maintained between the substance 184 and projection 178 of the outlet 176, the housing 168 may be cocked markedly without adversely affecting the opening and closing of the outlet 176 provided by float 166 and its valve 192. Even if the housing 168 should somehow become cocked after initial proper installation, again, this will not adversely affect the operation of float 166 because valve 192 is always maintained in proper alignment with the seat 182.

It is to be noted further that control 164 does not require the use of the standpipe 214 for mounting support, such being provided by cavity 180 on seat 182, the upstanding portion 178 of outlet 176, and the sealing substance 184. This arrangement makes control 164 ideally suited for replacing existing installations wherein only the standpipe 214 and outlet 176 is retained after removing all other components of the existing flush valve. It will be recognized, however, that standpipe 214, outlet 176, seat 182, and housing 168 could be fabricated as a unit in which event substance 184 would be replaced by a rigid connection between seat 182 and upstanding portion 178. In such event, the entire unit would simply be threaded into the floor of the liquid tank.

Having thus described the invention, what is claimed as new and desired to be secured by Letters Patent is:

1. A control for the outlet of a liquid supply tank comprising:

an open bottom housing defining a chamber extending upwardly from said open bottom;

means for mounting said housing within the tank with said open bottom overlying the outlet;

a float confined within said chamber and adapted for exposure to liquid within the tank through said open bottom of the housing, said float being vertically reciprocable within the chamber between a lowered position when air is trapped in the chamber above the float and an upwardly buoyed position when the trapped air is released;

a valve coupled with said float and reciprocable therewith for closing said outlet when the float is in its lowered position and for opening said outlet when the float is in its buoyed position; and actuator means for selectively trapping or releasing air within said chamber whereby to close or open said outlet respectively, said actuator means including means defining escape orifice means from said housing above said float and mechanism shiftable between positions opening and closing said orifice means.

said mechanism including a plunger shiftable into and out of sealing relationship with said orifice means, means yieldably biasing said plunger toward said sealing relationship, and a latch disposed to releasably retain the plunger out of said sealing relationship, said latch further being disposed for actuation by the float when the latter approaches its buoyed position for releasing the plunger.

2. A control for the outlet of a liquid supply tank comprising:

an open bottom housing defining a chamber extending upwardly from said open bottom;

means for mounting said housing within the tank with said open bottom overlying the outlet;

a float confined within said chamber and adapted for exposure to liquid within the tank through said open bottom of the housing, said float being vertically reciprocable within the chamber between a lowered position when air is trapped in the chamber above the float and an upwardly buoyed position when the trapped air is released;

a valve coupled with said float and reciprocable therewith for closing said outlet when the float is in its lowered position and for opening said outlet when the float is in its buoyed position; and actuator means for selectively trapping or releasing air within said chamber whereby to close or open said outlet respectively, said actuator means including means defining escape orifice means from said housing above said float and mechanism shiftable between positions opening and closing said orifice means, said mechanism including a hollow body having a valve chamber therewithin defining said escape orifice means, said valve chamber having a pair of spaced ports, one of said ports being coupled with a buoyant device disposed outside of said housing for automatically opening said one port when the liquid in said tank reaches a predetermined level, the other of said ports being coupled with manually actuatable means for selectively opening said other ports, said mechanism further including a valve piece selectively shiftable within said valve chamber between locations sealing said one port while opening said other, sealing said other port while opening said one port, and opening both ports.

3. A control for the outlet of a liquid supply tank including:

an open bottom housing defining a chamber extending upwardly from said open bottom;

a float confined within said chamber for vertical reciprocation between a lowered position when air is trapped in the chamber above the float and an upwardly buoyed position when the trapped air is released and the float is exposed to liquid;

a valve coupled with said float and reciprocable therewith;

an annular seat for said valve rigidly joined to the housing and suspended below said open bottom of the latter in disposition to be sealingly engaged by said valve when the float is in its lowered position; and means for mounting said housing within the tank with said seat overlying the outlet for opening and closing the latter when said valve is disengaged and engaged respectively with said seat.

4. A control as claimed in claim 3, wherein said housing is provided with a plurality of hangers supporting said seat, said hangers being spaced apart to define open areas therebetween through which liquid may reach said open bottom of the housing.

5. A control as claimed in claim 3, wherein said mounting means includes a downwardly facing annular cavity in said seat sized to receive a mating upwardly projecting portion of said outlet, said mounting means furher including a substance within said cavity for sealingly affixing the seat on to said projection.

6. A control for the outlet of a liquid supply tank comprising:

an open bottom housing of circular cross section defining a chamber extending upwardly from said open bottom;

means for mounting said housing within the tank with said open bottom overlying the outlet;

a float of circular cross section confined within said chamber and adapted for exposure to liquid within the tank through said open bottom of the housing, said float being vertically reciprocable within the chamber between a lowered position when air is trapped in the chamber above the float and an upwardly buoyed position when the trapped air is released;

a valve coupled with said float and reciprocable therewith for closing said outlet when the float is in its lowered position and for opening said outlet when the float is in its buoyed position;

actuator means for selectively trapping or releasing air within said chamber whereby to close or open said outlet respectively, said housing and said float each having a side and a top;

side spacer means between the sides of the housing and the float maintaining the latter concentric to the housing during reciprocation and forming an annulus between the sides; and top spacer means between the tops of the housing and the float for maintaining space between said tops when the float is in its buoyed position, said space between the tops communicating with said annulus between the sides for fully draining liquid from around and above the float as the liquid level in the tank falls below said bottom of the housing.

7. A control as claimed in claim 6, wherein said side spacer means comprises a plurality of normally vertically extending, circumferentially spaced ribs.

8. A control as claimed in claim 7, wherein said ribs are on said side of the housing.

9. A control as claimed in claim 6, wherein said side spacer means comprises an upper circumferentially extending series of relatively small projections and a lower circumferentially extending series of relatively small projections spaced substantially below said upper series.

10. A control as claimed in claim 9, wherein said projections are on said side of the float.

11. A control as claimed in claim 6, wherein said top spacer means comprises a series of radially extending, circumferentially spaced apart fins.

12. A control as clamed in claim 11, wherein said fins are on said top of the housing.

13. A control as claimed in claim 6, wherein the space between the tops is at least as great as the thickness of said annulus when the float is in its buoyed position.

14. A control as claimed in claim 6, wherein said valve includes a seal having a flat lowermost surface disposed for closing said outlet when the float is in its lowered position.

* * * * *